US008118447B2

(12) United States Patent
Simon et al.

(10) Patent No.: US 8,118,447 B2
(45) Date of Patent: Feb. 21, 2012

(54) LED LIGHTING APPARATUS WITH SWIVEL CONNECTION

(75) Inventors: David L. Simon, Grosse Point Woods, MI (US); John Ivey, Farmington Hills, MI (US)

(73) Assignee: Altair Engineering, Inc., Troy, MI (US)

( * ) Notice: Subject to any disclaimer, the term of this patent is extended or adjusted under 35 U.S.C. 154(b) by 558 days.

(21) Appl. No.: 11/961,701

(22) Filed: Dec. 20, 2007

(65) Prior Publication Data

US 2009/0159919 A1 Jun. 25, 2009

(51) Int. Cl.
*F21V 1/00* (2006.01)

(52) U.S. Cl. ..... 362/235; 326/555; 313/318.01; 313/318.02; 313/318.03; 313/623; 313/624; 313/625; 315/246

(58) Field of Classification Search ..... 315/246; 313/318.01–318.09, 623–625; 326/555; 362/235

See application file for complete search history.

(56) References Cited

U.S. PATENT DOCUMENTS

| | | | |
|---|---|---|---|
| 54,511 | A | 2/1920 | Owen |
| 58,105 | A | 6/1921 | Poritz |
| 79,814 | A | 8/1929 | Hoch |
| 80,419 | A | 1/1930 | Kramer |
| 84,763 | A | 7/1931 | Stange |
| D119,797 | S | 4/1940 | Winkler et al. |
| D125,312 | S | 2/1941 | Logan |
| 2,909,097 | A | 10/1959 | Alden |
| 3,318,185 | A | 5/1967 | Kott |
| 3,561,719 | A | 2/1971 | Grindle |
| 3,586,936 | A | 6/1971 | McLeroy |
| 3,601,621 | A | 8/1971 | Ritchie |
| 3,612,855 | A | 10/1971 | Juhnke |
| 3,643,088 | A | 2/1972 | Osteen et al. |
| 3,746,918 | A | 7/1973 | Drucker et al. |
| 3,818,216 | A | 6/1974 | Larraburu |
| 3,832,503 | A | 8/1974 | Crane |

(Continued)

FOREIGN PATENT DOCUMENTS

CN 1584388 A 2/2005

(Continued)

OTHER PUBLICATIONS

Written Opinion of the International Searching Authority dated Jul. 17, 2009 from the corresponding International Application No. PCT/US2008/085118 filed Dec. 1, 2008.

(Continued)

*Primary Examiner* — Kenneth Parker
*Assistant Examiner* — Dale E Page
(74) *Attorney, Agent, or Firm* — Young Basile

(57) ABSTRACT

Disclosed is a LED lighting apparatus with one or more swivel connections. The LED lighting apparatus includes a housing with at least one end, at least one light emitting diode extending along the housing and at least one end cap. The end cap has an opening with a sidewall to cap the end of the housing and a surface opposite the opening and spanning the sidewall. At least two pin connectors extend from the surface and are connectable to a standard fluorescent or incandescent light fixture. Various configurations are described such that the housing will rotate within the end caps with application of a rotational force after connection of the pin connectors to the light fixture to adjust the light output direction of the LED lighting apparatus.

6 Claims, 3 Drawing Sheets

U.S. PATENT DOCUMENTS

| | | | |
|---|---|---|---|
| 3,858,086 | A | 12/1974 | Anderson et al. |
| 3,909,670 | A | 9/1975 | Wakamatsu et al. |
| 3,924,120 | A | 12/1975 | Cox, III |
| 3,958,885 | A | 5/1976 | Stockinger et al. |
| 3,974,637 | A | 8/1976 | Bergey et al. |
| 3,993,386 | A | 11/1976 | Rowe |
| 4,001,571 | A | 1/1977 | Martin |
| 4,054,814 | A | 10/1977 | Fegley et al. |
| 4,070,568 | A | 1/1978 | Gala |
| 4,082,395 | A | 4/1978 | Donato et al. |
| 4,096,349 | A | 6/1978 | Donato |
| 4,102,558 | A | 7/1978 | Krachman |
| 4,107,581 | A | 8/1978 | Abernethy |
| 4,189,663 | A | 2/1980 | Schmutzer et al. |
| 4,211,955 | A | 7/1980 | Ray |
| 4,241,295 | A | 12/1980 | Williams, Jr. |
| 4,271,408 | A | 6/1981 | Teshima et al. |
| 4,272,689 | A | 6/1981 | Crosby et al. |
| 4,273,999 | A | 6/1981 | Pierpoint |
| 4,298,869 | A | 11/1981 | Okuno |
| 4,329,625 | A | 5/1982 | Nishizawa et al. |
| 4,339,788 | A | 7/1982 | White et al. |
| 4,342,947 | A | 8/1982 | Bloyd |
| 4,367,464 | A | 1/1983 | Kurahashi et al. |
| D268,134 | S | 3/1983 | Zurcher |
| 4,382,272 | A | 5/1983 | Quella et al. |
| 4,388,567 | A | 6/1983 | Yamazaki et al. |
| 4,388,589 | A | 6/1983 | Molldrem, Jr. |
| 4,392,187 | A | 7/1983 | Bornhorst |
| 4,394,719 | A | 7/1983 | Moberg |
| 4,420,711 | A | 12/1983 | Takahashi et al. |
| 4,455,562 | A | 6/1984 | Dolan et al. |
| 4,500,796 | A | 2/1985 | Quin |
| 4,581,687 | A | 4/1986 | Nakanishi |
| 4,597,033 | A | 6/1986 | Meggs et al. |
| 4,600,972 | A | 7/1986 | MacIntyre |
| 4,607,317 | A | 8/1986 | Lin |
| 4,622,881 | A | 11/1986 | Rand |
| 4,625,152 | A | 11/1986 | Nakai |
| 4,635,052 | A | 1/1987 | Aoike et al. |
| 4,647,217 | A | 3/1987 | Havel |
| 4,656,398 | A | 4/1987 | Michael et al. |
| 4,661,890 | A | 4/1987 | Watanabe |
| 4,668,895 | A | 5/1987 | Schneiter |
| 4,675,575 | A | 6/1987 | Smith et al. |
| 4,682,079 | A | 7/1987 | Sanders et al. |
| 4,686,425 | A | 8/1987 | Havel |
| 4,687,340 | A | 8/1987 | Havel |
| 4,688,154 | A | 8/1987 | Nilssen |
| 4,688,869 | A | 8/1987 | Kelly |
| 4,695,769 | A | 9/1987 | Schweickardt |
| 4,698,730 | A | 10/1987 | Sakai et al. |
| 4,701,669 | A | 10/1987 | Head et al. |
| 4,705,406 | A | 11/1987 | Havel |
| 4,707,141 | A | 11/1987 | Havel |
| D293,723 | S | 1/1988 | Buttner |
| 4,727,289 | A | 2/1988 | Uchida |
| 4,740,882 | A | 4/1988 | Miller |
| 4,748,545 | A | 5/1988 | Schmitt |
| 4,753,148 | A | 6/1988 | Johnson |
| 4,758,173 | A | 7/1988 | Northrop |
| 4,771,274 | A | 9/1988 | Havel |
| 4,780,621 | A | 10/1988 | Bartleucci et al. |
| 4,794,383 | A | 12/1988 | Havel |
| 4,818,072 | A | 4/1989 | Mohebban |
| 4,824,269 | A | 4/1989 | Havel |
| 4,837,565 | A | 6/1989 | White |
| 4,843,627 | A | 6/1989 | Stebbins |
| 4,845,481 | A | 7/1989 | Havel |
| 4,845,745 | A | 7/1989 | Havel |
| 4,857,801 | A | 8/1989 | Farrell |
| 4,863,223 | A | 9/1989 | Weissenbach et al. |
| 4,870,325 | A | 9/1989 | Kazar |
| 4,874,320 | A | 10/1989 | Freed et al. |
| 4,887,074 | A | 12/1989 | Simon et al. |
| 4,894,832 | A | 1/1990 | Colak |
| 4,901,207 | A | 2/1990 | Sato et al. |
| 4,912,371 | A | 3/1990 | Hamilton |
| 4,922,154 | A | 5/1990 | Cacoub |
| 4,934,852 | A | 6/1990 | Havel |
| 4,941,072 | A | 7/1990 | Yasumoto et al. |
| 4,943,900 | A | 7/1990 | Gartner |
| 4,962,687 | A | 10/1990 | Belliveau et al. |
| 4,965,561 | A | 10/1990 | Havel |
| 4,973,835 | A | 11/1990 | Kurosu et al. |
| 4,979,081 | A | 12/1990 | Leach et al. |
| 4,980,806 | A | 12/1990 | Taylor et al. |
| 4,992,704 | A | 2/1991 | Stinson |
| 5,003,227 | A | 3/1991 | Nilssen |
| 5,008,595 | A | 4/1991 | Kazar |
| 5,008,788 | A | 4/1991 | Palinkas |
| 5,010,459 | A | 4/1991 | Taylor et al. |
| 5,018,054 | A | 5/1991 | Ohashi |
| 5,027,037 | A | 6/1991 | Wei |
| 5,027,262 | A | 6/1991 | Freed |
| 5,032,960 | A | 7/1991 | Katoh |
| 5,034,807 | A | 7/1991 | Von Kohorn |
| 5,036,248 | A | 7/1991 | McEwan et al. |
| 5,038,255 | A | 8/1991 | Nishihashi et al. |
| 5,065,226 | A | 11/1991 | Kluitmans et al. |
| 5,072,216 | A | 12/1991 | Grange |
| 5,078,039 | A | 1/1992 | Tulk et al. |
| 5,083,063 | A | 1/1992 | Brooks |
| 5,088,013 | A | 2/1992 | Revis |
| 5,089,748 | A | 2/1992 | Ihms |
| 5,103,382 | A | 4/1992 | Kondo et al. |
| 5,122,733 | A | 6/1992 | Havel |
| 5,126,634 | A | 6/1992 | Johnson |
| 5,128,595 | A | 7/1992 | Hara |
| 5,130,909 | A | 7/1992 | Gross |
| 5,134,387 | A | 7/1992 | Smith et al. |
| 5,140,220 | A | 8/1992 | Hasegawa |
| 5,142,199 | A | 8/1992 | Elwell |
| 5,151,679 | A | 9/1992 | Dimmick |
| 5,154,641 | A | 10/1992 | McLaughlin |
| 5,161,879 | A | 11/1992 | McDermott |
| 5,161,882 | A | 11/1992 | Garrett |
| 5,164,715 | A | 11/1992 | Kashiwabara et al. |
| 5,184,114 | A | 2/1993 | Brown |
| 5,194,854 | A | 3/1993 | Havel |
| 5,198,756 | A | 3/1993 | Jenkins et al. |
| 5,209,560 | A | 5/1993 | Taylor et al. |
| 5,220,250 | A | 6/1993 | Szuba |
| 5,225,765 | A | 7/1993 | Callahan et al. |
| 5,226,723 | A | 7/1993 | Chen |
| 5,254,910 | A | 10/1993 | Yang |
| 5,256,948 | A | 10/1993 | Boldin et al. |
| 5,278,542 | A | 1/1994 | Smith et al. |
| 5,282,121 | A | 1/1994 | Bornhorst et al. |
| 5,283,517 | A | 2/1994 | Havel |
| 5,287,352 | A | 2/1994 | Jackson et al. |
| 5,294,865 | A | 3/1994 | Haraden |
| 5,298,871 | A | 3/1994 | Shimohara |
| 5,301,090 | A | 4/1994 | Hed |
| 5,303,124 | A | 4/1994 | Wrobel |
| 5,307,295 | A | 4/1994 | Taylor et al. |
| 5,321,593 | A | 6/1994 | Moates |
| 5,323,226 | A | 6/1994 | Schreder |
| 5,329,431 | A | 7/1994 | Taylor et al. |
| 5,344,068 | A | 9/1994 | Haessig |
| 5,350,977 | A | 9/1994 | Hamamoto et al. |
| 5,357,170 | A | 10/1994 | Luchaco et al. |
| 5,371,618 | A | 12/1994 | Tai et al. |
| 5,374,876 | A | 12/1994 | Horibata et al. |
| 5,375,043 | A | 12/1994 | Tokunaga |
| D354,360 | S | 1/1995 | Murata |
| 5,381,074 | A | 1/1995 | Rudzewicz et al. |
| 5,388,357 | A | 2/1995 | Malita |
| 5,402,702 | A | 4/1995 | Hata |
| 5,404,282 | A | 4/1995 | Klinke et al. |
| 5,406,176 | A | 4/1995 | Sugden |
| 5,410,328 | A | 4/1995 | Yoksza et al. |
| 5,412,284 | A | 5/1995 | Moore et al. |
| 5,412,552 | A | 5/1995 | Fernandes |
| 5,420,482 | A | 5/1995 | Phares |
| 5,421,059 | A | 6/1995 | Leffers, Jr. |
| 5,430,356 | A | 7/1995 | Ference et al. |

5,432,408 A 7/1995 Matsuda et al.
5,436,535 A 7/1995 Yang
5,436,853 A 7/1995 Shimohara
5,450,301 A 9/1995 Waltz et al.
5,461,188 A 10/1995 Drago et al.
5,463,280 A 10/1995 Johnson
5,465,144 A 11/1995 Parker et al.
5,475,300 A 12/1995 Havel
5,489,827 A 2/1996 Xia
5,491,402 A 2/1996 Small
5,493,183 A 2/1996 Kimball
5,504,395 A 4/1996 Johnson et al.
5,506,760 A 4/1996 Giebler et al.
5,513,082 A 4/1996 Asano
5,519,496 A 5/1996 Borgert et al.
5,530,322 A 6/1996 Ference et al.
5,544,809 A 8/1996 Keating et al.
5,545,950 A 8/1996 Cho
5,550,440 A 8/1996 Allison et al.
5,559,681 A 9/1996 Duarte
5,561,346 A 10/1996 Byrne
D376,030 S 11/1996 Cohen
5,575,459 A 11/1996 Anderson
5,575,554 A 11/1996 Guritz
5,581,158 A 12/1996 Quazi
5,592,051 A 1/1997 Korkala
5,600,199 A 2/1997 Martin, Sr. et al.
5,607,227 A 3/1997 Yasumoto et al.
5,608,290 A 3/1997 Hutchisson et al.
5,614,788 A 3/1997 Mullins et al.
5,621,282 A 4/1997 Haskell
5,621,603 A 4/1997 Adamec et al.
5,621,662 A 4/1997 Humphries et al.
5,622,423 A 4/1997 Lee
5,633,629 A 5/1997 Hochstein
5,634,711 A 6/1997 Kennedy et al.
5,640,061 A 6/1997 Bornhorst et al.
5,640,141 A 6/1997 Myllymaki
5,642,129 A 6/1997 Zavracky et al.
5,655,830 A 8/1997 Ruskouski
5,656,935 A 8/1997 Havel
5,661,645 A 8/1997 Hochstein
5,673,059 A 9/1997 Zavracky et al.
5,682,103 A 10/1997 Burrell
5,688,042 A 11/1997 Madadi et al.
5,697,695 A 12/1997 Lin et al.
5,701,058 A 12/1997 Roth
5,712,650 A 1/1998 Barlow
5,721,471 A 2/1998 Begemann et al.
5,725,148 A 3/1998 Hartman
5,726,535 A 3/1998 Yan
5,731,759 A 3/1998 Finucan
5,734,590 A 3/1998 Tebbe
5,751,118 A 5/1998 Mortimer
5,752,766 A 5/1998 Bailey et al.
5,765,940 A 6/1998 Levy et al.
5,769,527 A 6/1998 Taylor et al.
5,784,006 A 7/1998 Hochstein
5,790,329 A 8/1998 Klaus et al.
5,803,579 A 9/1998 Turnbull et al.
5,803,580 A 9/1998 Tseng
5,803,729 A 9/1998 Tsimerman
5,808,689 A 9/1998 Small
5,810,463 A 9/1998 Kawahara et al.
5,812,105 A 9/1998 Van de Ven
5,813,751 A 9/1998 Shaffer
5,813,753 A 9/1998 Vriens et al.
5,821,695 A 10/1998 Vilanilam et al.
5,825,051 A 10/1998 Bauer et al.
5,828,178 A 10/1998 York et al.
5,836,676 A 11/1998 Ando et al.
5,848,837 A 12/1998 Gustafson
5,850,126 A 12/1998 Kanbar
5,851,063 A 12/1998 Doughty et al.
5,852,658 A 12/1998 Knight et al.
5,854,542 A 12/1998 Forbes
RE36,030 E 1/1999 Nadeau
5,859,508 A 1/1999 Ge et al.
5,865,529 A 2/1999 Yan
5,890,794 A 4/1999 Abtahi et al.
5,896,010 A 4/1999 Mikolajczak et al.
5,904,415 A * 5/1999 Robertson et al. ..... 362/260
5,907,742 A 5/1999 Johnson et al.
5,912,653 A 6/1999 Fitch
5,921,660 A 7/1999 Yu
5,924,784 A 7/1999 Chliwnyj et al.
5,927,845 A 7/1999 Gustafson et al.
5,946,209 A 8/1999 Eckel et al.
5,949,347 A 9/1999 Wu
5,952,680 A 9/1999 Strite
5,959,547 A 9/1999 Tubel et al.
5,962,989 A 10/1999 Baker
5,962,992 A 10/1999 Huang et al.
5,963,185 A 10/1999 Havel
5,974,553 A 10/1999 Gandar
5,980,064 A 11/1999 Metroyanis
5,998,928 A 12/1999 Hipp
6,007,209 A 12/1999 Pelka
6,008,783 A 12/1999 Kitagawa et al.
6,011,691 A 1/2000 Schreffler
6,016,038 A 1/2000 Mueller et al.
6,018,237 A 1/2000 Havel
6,020,825 A 2/2000 Chansky et al.
6,025,550 A 2/2000 Kato
6,028,694 A 2/2000 Schmidt
6,030,099 A 2/2000 McDermott
6,031,343 A 2/2000 Recknagel et al.
D422,737 S 4/2000 Orozco
6,056,420 A 5/2000 Wilson et al.
6,068,383 A 5/2000 Robertson et al.
6,069,597 A 5/2000 Hansen
6,072,280 A 6/2000 Allen
6,084,359 A * 7/2000 Hetzel et al. ..... 315/248
6,091,200 A 7/2000 Lenz
6,092,915 A 7/2000 Rensch
6,095,661 A 8/2000 Lebens et al.
6,097,352 A 8/2000 Zavracky et al.
6,121,875 A 9/2000 Hamm et al.
6,127,783 A 10/2000 Pashley et al.
6,132,072 A 10/2000 Turnbull et al.
6,135,604 A 10/2000 Lin
6,139,174 A 10/2000 Butterworth
6,149,283 A 11/2000 Conway et al.
6,150,774 A 11/2000 Mueller et al.
6,151,529 A 11/2000 Batko
6,158,882 A 12/2000 Bischoff, Jr.
6,166,496 A 12/2000 Lys et al.
6,175,201 B1 1/2001 Sid
6,175,220 B1 1/2001 Billig et al.
6,181,126 B1 1/2001 Havel
6,183,086 B1 2/2001 Neubert
6,183,104 B1 2/2001 Ferrara
6,184,628 B1 2/2001 Ruthenberg
6,196,471 B1 3/2001 Ruthenberg
6,211,626 B1 4/2001 Lys et al.
6,215,409 B1 4/2001 Blach
6,217,190 B1 4/2001 Altman et al.
6,219,239 B1 4/2001 Mellberg et al.
6,227,679 B1 5/2001 Zhang et al.
6,238,075 B1 5/2001 Dealey, Jr. et al.
6,241,359 B1 6/2001 Lin
6,250,774 B1 6/2001 Begemann et al.
6,252,350 B1 6/2001 Alvarez
6,252,358 B1 6/2001 Xydis et al.
6,268,600 B1 7/2001 Nakamura et al.
6,273,338 B1 8/2001 White
6,275,397 B1 8/2001 McClain
6,283,612 B1 9/2001 Hunter
6,292,901 B1 9/2001 Lys et al.
6,293,684 B1 9/2001 Riblett
6,297,724 B1 10/2001 Bryans et al.
6,305,109 B1 10/2001 Lee
6,305,821 B1 10/2001 Hsieh
6,307,331 B1 10/2001 Bonasia et al.
6,310,590 B1 10/2001 Havel
6,323,832 B1 11/2001 Nishizawa et al.
6,325,651 B1 12/2001 Nishihara et al.
6,334,699 B1 1/2002 Gladnick 6,340,868 B1 1/2002 Lys et al.
6,354,714 B1 3/2002 Rhodes
6,361,186 B1 3/2002 Slayden
6,369,525 B1 4/2002 Chang et al.
6,371,637 B1 4/2002 Atchinson et al.
6,373,733 B1 4/2002 Wu et al.
6,379,022 B1 4/2002 Amerson et al.
D457,667 S 5/2002 Piepgras et al.
D457,669 S 5/2002 Piepgras et al.
D457,974 S 5/2002 Piepgras et al.
6,394,623 B1 5/2002 Tsui
D458,395 S 6/2002 Piepgras et al.
6,400,096 B1 6/2002 Wells et al.
6,404,131 B1 6/2002 Kawano et al.
6,411,022 B1 6/2002 Machida
6,422,716 B2 7/2002 Henrici et al.
6,428,189 B1 8/2002 Hochstein
D463,610 S 9/2002 Piepgras et al.
6,445,139 B1 9/2002 Marshall et al.
6,448,550 B1 9/2002 Nishimura
6,448,716 B1 9/2002 Hutchison
6,459,919 B1 10/2002 Lys et al.
6,469,457 B2 10/2002 Callahan
6,471,388 B1 10/2002 Marsh
6,472,823 B2 10/2002 Yen
6,473,002 B1 10/2002 Hutchison
D468,035 S 12/2002 Blanc et al.
6,488,392 B1 12/2002 Lu
6,495,964 B1 12/2002 Muthu et al.
6,527,411 B1 3/2003 Sayers
6,528,954 B1 3/2003 Lys et al.
6,528,958 B2 3/2003 Hulshof et al.
6,538,375 B1 3/2003 Duggal et al.
6,548,967 B1 4/2003 Dowling et al.
6,573,536 B1 6/2003 Dry
6,577,072 B2 6/2003 Saito et al.
6,577,080 B2 6/2003 Lys et al.
6,577,512 B2 6/2003 Tripathi et al.
6,577,794 B1 6/2003 Currie et al.
6,578,979 B2 6/2003 Truttmann-Battig
6,582,103 B1 6/2003 Popovich et al.
6,583,550 B2 6/2003 Iwasa et al.
6,583,573 B2 6/2003 Bierman
6,586,890 B2 7/2003 Min et al.
6,592,238 B2 7/2003 Cleaver et al.
6,596,977 B2 7/2003 Muthu et al.
6,598,996 B1 7/2003 Lodhie
6,608,453 B2 8/2003 Morgan et al.
6,608,614 B1 8/2003 Johnson
6,609,804 B2 8/2003 Nolan et al.
6,612,712 B2 9/2003 Nepil
6,612,717 B2 9/2003 Yen
6,621,222 B1 9/2003 Hong
6,623,151 B2 9/2003 Pederson
6,624,597 B2 9/2003 Dowling et al.
D481,484 S 10/2003 Cuevas et al.
6,634,770 B2 10/2003 Cao
6,634,779 B2 10/2003 Reed
6,636,003 B2 10/2003 Rahm et al.
6,639,349 B1 10/2003 Bahadur
6,641,284 B2 11/2003 Stopa et al.
6,659,622 B2 12/2003 Katogi et al.
6,660,935 B2 12/2003 Southard et al.
6,666,689 B1 12/2003 Savage, Jr.
6,667,623 B2 12/2003 Bourgault et al.
6,674,096 B2 1/2004 Sommers
6,676,284 B1 1/2004 Wynne Willson
6,679,621 B2 1/2004 West et al.
6,681,154 B2 1/2004 Nierlich et al.
6,682,205 B2 1/2004 Lin
6,683,419 B2 1/2004 Kriparos
6,700,136 B2 3/2004 Guida
6,712,486 B1 3/2004 Popovich et al.
6,717,376 B2 4/2004 Lys et al.
6,717,526 B2 4/2004 Martineau et al.
6,720,745 B2 4/2004 Lys et al.
6,726,348 B2 4/2004 Gloisten
6,741,324 B1 5/2004 Kim, II
D491,678 S 6/2004 Piepgras
D492,042 S 6/2004 Piepgras
6,744,223 B2 6/2004 Laflamme et al.
6,748,299 B1 6/2004 Motoyama
6,762,562 B2 7/2004 Leong
6,774,584 B2 8/2004 Lys et al.
6,777,891 B2 8/2004 Lys et al.
6,781,329 B2 8/2004 Mueller et al.
6,787,999 B2 9/2004 Stimac et al.
6,788,000 B2 9/2004 Appelberg et al.
6,788,011 B2 9/2004 Mueller et al.
6,791,840 B2 9/2004 Chun
6,801,003 B2 10/2004 Schanberger et al.
6,806,659 B1 10/2004 Mueller et al.
6,814,470 B2 11/2004 Rizkin et al.
6,815,724 B2 11/2004 Dry
6,846,094 B2 1/2005 Luk
6,851,816 B2 2/2005 Wu et al.
6,851,832 B2 2/2005 Tieszen
6,853,151 B2 2/2005 Leong et al.
6,853,563 B1 2/2005 Yang et al.
6,857,924 B2 2/2005 Fu et al.
6,860,628 B2 3/2005 Robertson
6,866,401 B2 3/2005 Sommers et al.
6,869,204 B2 3/2005 Morgan et al.
6,871,981 B2 3/2005 Alexanderson et al.
6,874,924 B1 4/2005 Hulse et al.
6,879,883 B1 4/2005 Motoyama
6,882,111 B2 4/2005 Kan et al.
6,883,929 B2 4/2005 Dowling
6,883,934 B2 4/2005 Kawakami
6,888,322 B2 5/2005 Dowling et al.
6,897,624 B2 5/2005 Lys et al.
6,909,239 B2 6/2005 Gauna
6,909,921 B1 6/2005 Bilger
6,918,680 B2 7/2005 Seeberger
6,921,181 B2 7/2005 Yen
6,936,968 B2 8/2005 Cross et al.
6,936,978 B2 8/2005 Morgan et al.
6,940,230 B2 9/2005 Myron et al.
6,948,829 B2 9/2005 Verdes et al.
6,964,501 B2 11/2005 Ryan
6,965,197 B2 11/2005 Tyan et al.
6,965,205 B2 11/2005 Piepgras et al.
6,967,448 B2 11/2005 Morgan et al.
6,969,179 B2 11/2005 Sloan et al.
6,969,186 B2 11/2005 Sonderegger
6,969,954 B2 11/2005 Lys
6,975,079 B2 12/2005 Lys et al.
6,979,097 B2 12/2005 Elam et al.
6,982,518 B2 1/2006 Chou et al.
6,995,681 B2 2/2006 Pederson
6,997,576 B1 2/2006 Lodhie et al.
7,004,603 B2 2/2006 Knight
D518,218 S 3/2006 Roberge et al.
7,008,079 B2 3/2006 Smith
7,014,336 B1 3/2006 Ducharme et al.
7,015,650 B2 3/2006 McGrath
7,018,063 B2 3/2006 Michael
7,021,799 B2 4/2006 Mizuyoshi
7,021,809 B2 4/2006 Iwasa et al.
7,024,256 B2 4/2006 Krzyzanowski et al.
7,031,920 B2 4/2006 Dowling et al.
7,033,036 B2 4/2006 Pederson
7,038,398 B1 5/2006 Lys et al.
7,038,399 B2 5/2006 Lys et al.
7,042,172 B2 5/2006 Dowling et al.
7,048,423 B2 5/2006 Stepanenko et al.
7,049,761 B2 5/2006 Timmermans et al.
7,052,171 B1 * 5/2006 Lefebvre et al. ..... 362/649
7,053,557 B2 5/2006 Cross et al.
7,064,498 B2 6/2006 Dowling et al.
7,064,674 B2 6/2006 Pederson
7,067,992 B2 6/2006 Leong et al.
7,077,978 B2 7/2006 Setlur et al.
7,080,927 B2 7/2006 Feuerborn et al.
7,086,747 B2 8/2006 Nielson et al.
7,088,014 B2 8/2006 Nierlich et al.
7,088,904 B2 8/2006 Ryan, Jr.
7,102,902 B1 9/2006 Brown et al.

7,113,541 B1 9/2006 Lys et al.
7,114,830 B2 10/2006 Robertson
7,114,834 B2 10/2006 Rivas
7,118,262 B2 10/2006 Negley
7,119,503 B2 10/2006 Kemper
7,121,679 B2 10/2006 Fujimoto
7,122,976 B1 10/2006 Null et al.
7,128,442 B2 10/2006 Lee et al.
7,128,454 B2 10/2006 Kim et al.
D532,532 S 11/2006 Maxik
7,132,635 B2 11/2006 Dowling
7,132,785 B2 11/2006 Ducharme
7,132,804 B2 11/2006 Lys et al.
7,135,824 B2 11/2006 Lys et al.
7,139,617 B1 11/2006 Morgan et al.
7,144,135 B2 12/2006 Martin et al.
7,153,002 B2 12/2006 Kim et al.
7,161,311 B2 1/2007 Mueller et al.
7,161,313 B2 1/2007 Piepgras et al.
7,161,556 B2 1/2007 Morgan et al.
7,164,110 B2 1/2007 Pitigoi-Aron et al.
7,165,863 B1 1/2007 Thomas et al.
7,165,866 B2 1/2007 Li
7,167,777 B2 1/2007 Budike, Jr.
7,168,843 B2 1/2007 Striebel
D536,468 S 2/2007 Crosby
7,178,941 B2 2/2007 Roberge
7,180,252 B2 2/2007 Lys et al.
D538,950 S 3/2007 Maxik
D538,952 S 3/2007 Maxik et al.
D538,962 S 3/2007 Elliott
7,186,003 B2 3/2007 Dowling et al.
7,186,005 B2 3/2007 Hulse
7,187,141 B2 3/2007 Mueller et al.
7,190,126 B1 3/2007 Paton
7,192,154 B2 3/2007 Becker
7,201,491 B2 4/2007 Bayat
7,201,497 B2 4/2007 Weaver, Jr. et al.
7,202,613 B2 4/2007 Morgan et al.
7,204,615 B2 4/2007 Arik et al.
7,204,622 B2 4/2007 Dowling et al.
7,207,696 B1 4/2007 Lin
7,210,818 B2 5/2007 Luk
7,210,957 B2 5/2007 Mrakovich
7,211,959 B1 5/2007 Chou
7,213,934 B2 5/2007 Zarian et al.
7,217,012 B2 5/2007 Southard et al.
7,217,022 B2 5/2007 Ruffin
7,218,056 B1 5/2007 Harwood
7,218,238 B2 5/2007 Right et al.
7,220,015 B2 5/2007 Dowling
7,221,104 B2 5/2007 Lys et al.
7,221,110 B2 5/2007 Sears et al.
7,224,000 B2 5/2007 Aanegola et al.
7,226,189 B2 6/2007 Lee et al.
7,228,052 B1 6/2007 Lin
7,228,190 B2 6/2007 Dowling et al.
7,231,060 B2 6/2007 Dowling et al.
7,233,115 B2 6/2007 Lys
7,233,831 B2 6/2007 Blackwell
7,236,366 B2 6/2007 Chen
7,237,924 B2 7/2007 Martineau et al.
7,237,925 B2 7/2007 Mayer et al.
7,239,532 B1 7/2007 Hsu et al.
7,241,038 B2 7/2007 Naniwa et al.
7,242,152 B2 7/2007 Dowling et al.
7,246,926 B2 7/2007 Harwood
7,246,931 B2 7/2007 Hsieh et al.
7,248,239 B2 7/2007 Dowling et al.
7,249,269 B1 7/2007 Motoyama
7,249,865 B2 7/2007 Robertson
D548,868 S 8/2007 Roberge et al.
7,252,408 B2 8/2007 Mazzochette et al.
7,253,566 B2 8/2007 Lys et al.
7,255,457 B2 8/2007 Ducharme et al.
7,255,460 B2 8/2007 Lee
7,256,554 B2 8/2007 Lys
7,258,458 B2 8/2007 Mochiachvili et al.
7,258,467 B2 8/2007 Saccomanno
7,259,528 B2 8/2007 Pilz
7,262,439 B2 8/2007 Setlur et al.
7,264,372 B2 9/2007 Maglica
7,267,467 B2 9/2007 Wu
7,270,443 B2 9/2007 Kurtz
7,271,794 B1 9/2007 Cheng et al.
7,273,300 B2 9/2007 Mrakovich
7,274,045 B2 9/2007 Chandran et al.
7,274,160 B2 9/2007 Mueller et al.
D553,267 S 10/2007 Yuen
7,285,801 B2 10/2007 Eliashevich et al.
7,288,902 B1 10/2007 Melanson
7,296,912 B2 11/2007 Beauchamp
7,300,184 B2 11/2007 Ichikawa et al.
7,300,192 B2 11/2007 Mueller et al.
D556,937 S 12/2007 Ly
D557,854 S 12/2007 Lewis
7,303,300 B2 12/2007 Dowling et al.
7,306,353 B2 12/2007 Popovich et al.
7,307,391 B2 12/2007 Shan
7,308,296 B2 12/2007 Lys et al.
7,309,965 B2 12/2007 Dowling et al.
7,318,658 B2 1/2008 Wang et al.
7,319,244 B2 1/2008 Liu et al.
7,319,246 B2 1/2008 Soules et al.
7,321,191 B2 1/2008 Setlur et al.
7,326,964 B2 2/2008 Lim et al.
7,329,031 B2 2/2008 Liaw et al.
D563,589 S 3/2008 Hariri et al.
7,345,320 B2 3/2008 Dahm
7,348,604 B2 3/2008 Matheson
7,350,936 B2 4/2008 Ducharme et al.
7,350,952 B2 4/2008 Nishigaki
7,352,138 B2 4/2008 Lys et al.
7,352,339 B2 4/2008 Morgan et al.
7,353,071 B2 4/2008 Blackwell et al.
7,358,679 B2 4/2008 Lys et al.
7,358,929 B2 4/2008 Mueller et al.
7,374,327 B2 5/2008 Schexnaider
7,385,359 B2 6/2008 Dowling et al.
7,391,159 B2 6/2008 Harwood
7,396,146 B2 7/2008 Wang
7,401,935 B2 7/2008 VanderSchuit
7,401,945 B2 7/2008 Zhang
7,427,840 B2 9/2008 Morgan et al.
7,429,117 B2 9/2008 Pohlert et al.
7,438,441 B2 10/2008 Sun et al.
7,449,847 B2 11/2008 Schanberger et al.
7,476,004 B2 1/2009 Chan
7,478,924 B2 1/2009 Robertson
7,490,957 B2 2/2009 Leong et al.
7,497,596 B2 3/2009 Ge
7,507,001 B2 3/2009 Kit
7,510,299 B2 3/2009 Timmermans et al.
7,521,872 B2 4/2009 Bruning
7,524,089 B2 4/2009 Park
7,534,002 B2 5/2009 Yamaguchi et al.
7,549,769 B2 6/2009 Kim et al.
7,556,396 B2 7/2009 Kuo et al.
7,572,030 B2 8/2009 Booth et al.
7,575,339 B2 8/2009 Hung
7,619,366 B2 11/2009 Diederiks
7,635,201 B2 12/2009 Deng
2001/0033488 A1 10/2001 Chliwnyj et al.
2001/0045803 A1 11/2001 Cencur
2002/0038157 A1 3/2002 Dowling et al.
2002/0044066 A1 4/2002 Dowling et al.
2002/0047569 A1 4/2002 Dowling et al.
2002/0047624 A1 4/2002 Stam et al.
2002/0047628 A1 4/2002 Morgan et al.
2002/0048169 A1 4/2002 Dowling et al.
2002/0057061 A1 5/2002 Mueller et al.
2002/0060526 A1* 5/2002 Timmermans et al. ..... 315/246
2002/0070688 A1 6/2002 Dowling et al.
2002/0074559 A1 6/2002 Dowling et al.
2002/0078221 A1 6/2002 Blackwell et al.
2002/0101197 A1 8/2002 Lys et al.
2002/0113555 A1 8/2002 Lys et al.
2002/0130627 A1 9/2002 Morgan et al.

2002/0145394 A1 10/2002 Morgan et al.
2002/0145869 A1 10/2002 Dowling
2002/0152045 A1 10/2002 Dowling et al.
2002/0152298 A1 10/2002 Kikta et al.
2002/0153851 A1 10/2002 Morgan et al.
2002/0158583 A1 10/2002 Lys et al.
2002/0163316 A1 11/2002 Lys et al.
2002/0171365 A1 11/2002 Morgan et al.
2002/0171377 A1 11/2002 Mueller et al.
2002/0171378 A1 11/2002 Morgan et al.
2002/0176259 A1 11/2002 Ducharme
2002/0179816 A1 12/2002 Haines et al.
2002/0195975 A1 12/2002 Schanberger et al.
2003/0011538 A1 1/2003 Lys et al.
2003/0028260 A1 2/2003 Blackwell
2003/0031015 A1 2/2003 Ishibashi
2003/0057884 A1 3/2003 Dowling et al.
2003/0057886 A1 3/2003 Lys et al.
2003/0057887 A1 3/2003 Dowling et al.
2003/0057890 A1 3/2003 Lys et al.
2003/0076281 A1 4/2003 Morgan et al.
2003/0085710 A1 5/2003 Bourgault et al.
2003/0095404 A1 5/2003 Becks et al.
2003/0100837 A1 5/2003 Lys et al.
2003/0102810 A1 6/2003 Cross et al.
2003/0133292 A1 7/2003 Mueller et al.
2003/0137258 A1 7/2003 Piepgras et al.
2003/0185005 A1 10/2003 Sommers et al.
2003/0185014 A1 10/2003 Gloisten
2003/0189412 A1 10/2003 Cunningham
2003/0222587 A1 12/2003 Dowling, Jr. et al.
2004/0003545 A1 1/2004 Gillespie
2004/0012959 A1 1/2004 Robertson et al.
2004/0036006 A1 2/2004 Dowling
2004/0037088 A1 2/2004 English et al.
2004/0052076 A1 3/2004 Mueller et al.
2004/0062041 A1 4/2004 Cross et al.
2004/0075572 A1 4/2004 Buschmann et al.
2004/0080960 A1 4/2004 Wu
2004/0090191 A1 5/2004 Mueller et al.
2004/0090787 A1 5/2004 Dowling et al.
2004/0105261 A1 6/2004 Ducharme et al.
2004/0113568 A1 6/2004 Dowling et al.
2004/0116039 A1 6/2004 Mueller et al.
2004/0124782 A1 7/2004 Yu
2004/0130909 A1 7/2004 Mueller et al.
2004/0141321 A1 7/2004 Dowling et al.
2004/0155609 A1 8/2004 Lys et al.
2004/0160199 A1 8/2004 Morgan et al.
2004/0178751 A1 9/2004 Mueller et al.
2004/0189218 A1 9/2004 Leong et al.
2004/0189262 A1 9/2004 McGrath
2004/0212320 A1 10/2004 Dowling et al.
2004/0212321 A1 10/2004 Lys et al.
2004/0212993 A1 10/2004 Morgan et al.
2004/0223328 A1 11/2004 Lee et al.
2004/0240890 A1 12/2004 Lys et al.
2004/0257007 A1 12/2004 Lys et al.
2005/0013133 A1 1/2005 Yeh
2005/0024877 A1 2/2005 Frederick
2005/0030744 A1 2/2005 Ducharme et al.
2005/0035728 A1 2/2005 Schanberger et al.
2005/0036300 A1 2/2005 Dowling et al.
2005/0040774 A1 2/2005 Mueller et al.
2005/0041161 A1 2/2005 Dowling et al.
2005/0041424 A1 2/2005 Ducharme
2005/0043907 A1 2/2005 Eckel et al.
2005/0044617 A1 3/2005 Mueller et al.
2005/0047132 A1 3/2005 Dowling et al.
2005/0047134 A1 3/2005 Mueller et al.
2005/0062440 A1 3/2005 Lys et al.
2005/0063194 A1 3/2005 Lys et al.
2005/0078477 A1 4/2005 Lo
2005/0099824 A1 5/2005 Dowling et al.
2005/0107694 A1 5/2005 Jansen et al.
2005/0110384 A1 5/2005 Peterson
2005/0116667 A1 6/2005 Mueller et al.
2005/0128751 A1 6/2005 Roberge et al.
2005/0141225 A1 6/2005 Striebel
2005/0151489 A1 7/2005 Lys et al.
2005/0151663 A1 7/2005 Tanguay
2005/0154494 A1 7/2005 Ahmed
2005/0162093 A1 7/2005 Timmermans et al.
2005/0174473 A1 8/2005 Morgan et al.
2005/0174780 A1 8/2005 Park
2005/0184667 A1 8/2005 Sturman et al.
2005/0201112 A1 9/2005 Machi et al.
2005/0206529 A1 9/2005 St.-Germain
2005/0213320 A1 9/2005 Kazuhiro
2005/0213352 A1 9/2005 Lys
2005/0213353 A1 9/2005 Lys
2005/0218838 A1 10/2005 Lys
2005/0218870 A1 10/2005 Lys
2005/0219860 A1 10/2005 Schexnaider
2005/0219872 A1 10/2005 Lys
2005/0225979 A1 10/2005 Robertson et al.
2005/0231133 A1 10/2005 Lys
2005/0236029 A1 10/2005 Dowling
2005/0236998 A1 10/2005 Mueller et al.
2005/0248299 A1 11/2005 Chemel et al.
2005/0253533 A1 11/2005 Lys et al.
2005/0259424 A1 11/2005 Zampini, II et al.
2005/0265019 A1 12/2005 Sommers et al.
2005/0275626 A1 12/2005 Mueller et al.
2005/0276051 A1 12/2005 Caudle et al.
2005/0276053 A1 12/2005 Nortrup et al.
2005/0276064 A1 12/2005 Wu
2005/0285547 A1 12/2005 Piepgras et al.
2006/0002110 A1 1/2006 Dowling et al.
2006/0012987 A9 1/2006 Ducharme et al.
2006/0012997 A1 1/2006 Catalano et al.
2006/0016960 A1 1/2006 Morgan et al.
2006/0022214 A1 2/2006 Morgan et al.
2006/0028155 A1 2/2006 Young
2006/0028837 A1 2/2006 Mrakovich
2006/0034078 A1 2/2006 Kovacik
2006/0050509 A9 3/2006 Dowling et al.
2006/0050514 A1 3/2006 Opolka
2006/0076908 A1 4/2006 Morgan et al.
2006/0092640 A1 5/2006 Li
2006/0098077 A1 5/2006 Dowling
2006/0104058 A1 5/2006 Chemel et al.
2006/0109648 A1 5/2006 Trenchard
2006/0109649 A1 5/2006 Ducharme et al.
2006/0109661 A1 5/2006 Coushaine et al.
2006/0126325 A1* 6/2006 Lefebvre et al. ..... 362/217
2006/0132061 A1 6/2006 McCormick et al.
2006/0132323 A1 6/2006 Grady, Jr.
2006/0146531 A1 7/2006 Reo et al.
2006/0152172 A9 7/2006 Mueller et al.
2006/0158881 A1 7/2006 Dowling
2006/0170376 A1 8/2006 Piepgras et al.
2006/0192502 A1 8/2006 Brown et al.
2006/0193131 A1 8/2006 McGrath et al.
2006/0197661 A1 9/2006 Tracy et al.
2006/0198128 A1 9/2006 Piepgras et al.
2006/0208667 A1 9/2006 Lys et al.
2006/0221606 A1 10/2006 Dowling et al.
2006/0221619 A1 10/2006 Nishigaki
2006/0232974 A1 10/2006 Lee et al.
2006/0262516 A9 11/2006 Dowling et al.
2006/0262521 A1 11/2006 Piepgras et al.
2006/0262544 A1 11/2006 Piepgras et al.
2006/0262545 A1 11/2006 Piepgras et al.
2006/0273741 A1 12/2006 Stalker, III
2006/0274529 A1 12/2006 Cao
2006/0285325 A1 12/2006 Ducharme et al.
2007/0035255 A1 2/2007 Shuster et al.
2007/0040516 A1 2/2007 Chen
2007/0041220 A1 2/2007 Lynch
2007/0047227 A1 3/2007 Ducharme
2007/0053182 A1 3/2007 Robertson
2007/0053208 A1 3/2007 Justel et al.
2007/0064419 A1 3/2007 Gandhi
2007/0070621 A1 3/2007 Rivas
2007/0070631 A1 3/2007 Huang et al.
2007/0081423 A1 4/2007 Chien
2007/0086754 A1 4/2007 Lys et al.

| | | | |
|---|---|---|---|
| 2007/0086912 | A1 | 4/2007 | Dowling et al. |
| 2007/0097678 | A1 | 5/2007 | Yang |
| 2007/0115658 | A1 | 5/2007 | Mueller et al. |
| 2007/0115665 | A1 | 5/2007 | Mueller et al. |
| 2007/0120594 | A1 | 5/2007 | Balakrishnan et al. |
| 2007/0127234 | A1 | 6/2007 | Jervey, III |
| 2007/0133202 | A1* | 6/2007 | Huang et al. ..... 362/235 |
| 2007/0139938 | A1 | 6/2007 | Petroski et al. |
| 2007/0145915 | A1 | 6/2007 | Roberge et al. |
| 2007/0147046 | A1 | 6/2007 | Arik et al. |
| 2007/0152797 | A1 | 7/2007 | Chemel et al. |
| 2007/0153514 | A1 | 7/2007 | Dowling et al. |
| 2007/0159828 | A1 | 7/2007 | Wang |
| 2007/0165402 | A1 | 7/2007 | Weaver, Jr. et al. |
| 2007/0173978 | A1 | 7/2007 | Fein et al. |
| 2007/0177382 | A1 | 8/2007 | Pritchard |
| 2007/0182387 | A1 | 8/2007 | Weirich |
| 2007/0188114 | A1 | 8/2007 | Lys et al. |
| 2007/0188427 | A1 | 8/2007 | Lys et al. |
| 2007/0189026 | A1 | 8/2007 | Chemel et al. |
| 2007/0195526 | A1 | 8/2007 | Dowling et al. |
| 2007/0195527 | A1 | 8/2007 | Russell |
| 2007/0195532 | A1 | 8/2007 | Reisenauer et al. |
| 2007/0205712 | A1 | 9/2007 | Radkov et al. |
| 2007/0206375 | A1 | 9/2007 | Piepgras et al. |
| 2007/0211463 | A1 | 9/2007 | Chevalier et al. |
| 2007/0228999 | A1 | 10/2007 | Kit |
| 2007/0235751 | A1 | 10/2007 | Radkov et al. |
| 2007/0236156 | A1 | 10/2007 | Lys et al. |
| 2007/0237284 | A1 | 10/2007 | Lys et al. |
| 2007/0240346 | A1 | 10/2007 | Li et al. |
| 2007/0241657 | A1 | 10/2007 | Radkov et al. |
| 2007/0242466 | A1 | 10/2007 | Wu et al. |
| 2007/0247842 | A1 | 10/2007 | Zampini et al. |
| 2007/0247847 | A1 | 10/2007 | Villard |
| 2007/0247851 | A1 | 10/2007 | Villard |
| 2007/0258231 | A1 | 11/2007 | Koerner et al. |
| 2007/0258240 | A1 | 11/2007 | Ducharme et al. |
| 2007/0263379 | A1 | 11/2007 | Dowling |
| 2007/0274070 | A1 | 11/2007 | Wedell |
| 2007/0281520 | A1 | 12/2007 | Insalaco et al. |
| 2007/0285926 | A1 | 12/2007 | Maxik |
| 2007/0285933 | A1 | 12/2007 | Southard et al. |
| 2007/0290625 | A1 | 12/2007 | He et al. |
| 2007/0291483 | A1 | 12/2007 | Lys |
| 2008/0003664 | A1 | 1/2008 | Tysoe et al. |
| 2008/0007945 | A1 | 1/2008 | Kelly et al. |
| 2008/0012502 | A1 | 1/2008 | Lys |
| 2008/0012506 | A1 | 1/2008 | Mueller et al. |
| 2008/0013316 | A1 | 1/2008 | Chiang |
| 2008/0013324 | A1 | 1/2008 | Yu |
| 2008/0018261 | A1 | 1/2008 | Kastner |
| 2008/0037245 | A1 | 2/2008 | Chan |
| 2008/0037284 | A1 | 2/2008 | Rudisill |
| 2008/0062680 | A1 | 3/2008 | Timmermans et al. |
| 2008/0089075 | A1 | 4/2008 | Hsu |
| 2008/0092800 | A1 | 4/2008 | Smith et al. |
| 2008/0093615 | A1 | 4/2008 | Lin et al. |
| 2008/0093998 | A1 | 4/2008 | Dennery et al. |
| 2008/0094837 | A1 | 4/2008 | Dobbins et al. |
| 2008/0130267 | A1 | 6/2008 | Dowling et al. |
| 2008/0158871 | A1 | 7/2008 | McAvoy et al. |
| 2008/0158887 | A1 | 7/2008 | Zhu et al. |
| 2008/0164826 | A1 | 7/2008 | Lys |
| 2008/0164827 | A1 | 7/2008 | Lys |
| 2008/0164854 | A1 | 7/2008 | Lys |
| 2008/0175003 | A1 | 7/2008 | Tsou et al. |
| 2008/0180036 | A1 | 7/2008 | Garrity et al. |
| 2008/0186704 | A1 | 8/2008 | Chou et al. |
| 2008/0192436 | A1 | 8/2008 | Peng et al. |
| 2008/0211419 | A1 | 9/2008 | Garrity |
| 2008/0224629 | A1 | 9/2008 | Melanson |
| 2008/0224636 | A1 | 9/2008 | Melanson |
| 2008/0253125 | A1 | 10/2008 | Kang et al. |
| 2008/0258647 | A1 | 10/2008 | Scianna |
| 2008/0285257 | A1 | 11/2008 | King |
| 2008/0290814 | A1 | 11/2008 | Leong et al. |
| 2008/0315784 | A1 | 12/2008 | Tseng |
| 2009/0002995 | A1 | 1/2009 | Lee et al. |
| 2009/0016063 | A1 | 1/2009 | Hu |
| 2009/0046473 | A1 | 2/2009 | Tsai et al. |
| 2009/0052186 | A1 | 2/2009 | Xue |
| 2009/0086492 | A1 | 4/2009 | Meyer |
| 2009/0091938 | A1 | 4/2009 | Jacobson et al. |
| 2009/0185373 | A1 | 7/2009 | Grajcar |
| 2009/0303720 | A1 | 12/2009 | McGrath |

FOREIGN PATENT DOCUMENTS

| | | | |
|---|---|---|---|
| CN | 2766345 | Y | 3/2006 |
| CN | 2869556 | Y | 2/2007 |
| EP | 0013782 | B1 | 3/1983 |
| EP | 0091172 | A2 | 10/1983 |
| EP | 0124924 | B1 | 9/1987 |
| EP | 0174699 | B1 | 11/1988 |
| EP | 0197602 | B1 | 11/1990 |
| EP | 0214701 | B1 | 3/1992 |
| EP | 0262713 | B1 | 6/1992 |
| EP | 0203668 | B1 | 2/1993 |
| EP | 0272749 | B1 | 8/1993 |
| EP | 0337567 | B1 | 11/1993 |
| EP | 0390262 | B1 | 12/1993 |
| EP | 0359329 | B1 | 3/1994 |
| EP | 0403011 | B1 | 4/1994 |
| EP | 0632511 | A2 | 1/1995 |
| EP | 0432848 | B1 | 4/1995 |
| EP | 0403001 | B1 | 8/1995 |
| EP | 0525876 | B1 | 5/1996 |
| EP | 0714556 | B1 | 1/1999 |
| EP | 0458408 | B1 | 9/1999 |
| EP | 0578302 | B1 | 9/1999 |
| EP | 0723701 | B1 | 1/2000 |
| EP | 0787419 | B1 | 5/2001 |
| EP | 1195740 | A2 | 4/2002 |
| EP | 1016062 | B1 | 8/2002 |
| EP | 1195740 | A3 | 1/2003 |
| EP | 1149510 | B1 | 2/2003 |
| EP | 1056993 | B1 | 3/2003 |
| EP | 0766436 | B1 | 5/2003 |
| EP | 0924281 | B1 | 5/2003 |
| EP | 0826167 | B1 | 6/2003 |
| EP | 1147686 | B1 | 1/2004 |
| EP | 1142452 | B1 | 3/2004 |
| EP | 1145602 | B1 | 3/2004 |
| EP | 1422975 | A1 | 5/2004 |
| EP | 0890059 | B1 | 6/2004 |
| EP | 1348319 | B1 | 6/2005 |
| EP | 1037862 | B1 | 7/2005 |
| EP | 1346609 | B1 | 8/2005 |
| EP | 1321012 | B1 | 12/2005 |
| EP | 1610593 | A2 | 12/2005 |
| EP | 1415517 | B1 | 5/2006 |
| EP | 1415518 | B1 | 5/2006 |
| EP | 1438877 | B1 | 5/2006 |
| EP | 1166604 | B1 | 6/2006 |
| EP | 1479270 | B1 | 7/2006 |
| EP | 1348318 | B1 | 8/2006 |
| EP | 1399694 | B1 | 8/2006 |
| EP | 1461980 | B1 | 10/2006 |
| EP | 1110120 | B1 | 4/2007 |
| EP | 1440604 | B1 | 4/2007 |
| EP | 1047903 | B1 | 6/2007 |
| EP | 1500307 | B1 | 6/2007 |
| EP | 0922305 | B1 | 8/2007 |
| EP | 0922306 | B1 | 8/2007 |
| EP | 1194918 | B1 | 8/2007 |
| EP | 1048085 | B1 | 11/2007 |
| EP | 1763650 | B1 | 12/2007 |
| EP | 1337784 | B1 | 6/2009 |
| JP | 6-54103 | U | 7/1994 |
| JP | H6-54103 | | 7/1994 |
| JP | 7-249467 | | 9/1995 |
| JP | 07-249467 | A | 9/1995 |
| JP | 08-162677 | | 6/1996 |
| JP | 11-135274 | A | 5/1999 |
| JP | 2001-238272 | A | 8/2001 |
| JP | 2002-141555 | A | 5/2002 |
| JP | 3098271 | U | 2/2004 |
| JP | 2004-335426 | | 11/2004 |

| | | | |
|---|---|---|---|
| JP | 2005-158363 | A | 6/2005 |
| JP | 2005-166617 | A | 6/2005 |
| JP | 2005-347214 | A | 12/2005 |
| JP | 2006-507641 | A | 3/2006 |
| KR | 10-2004-0008244 | A | 1/2004 |
| KR | 20-0430022 | Y1 | 11/2006 |
| KR | 10-0781652 | B1 | 12/2007 |
| WO | 99/10867 | A1 | 3/1999 |
| WO | 99/31560 | A2 | 6/1999 |
| WO | 00/01067 | A2 | 1/2000 |
| WO | 02/25842 | A2 | 3/2002 |
| WO | 02/061330 | A2 | 8/2002 |
| WO | 02/069306 | A2 | 9/2002 |
| WO | 02/091805 | A2 | 11/2002 |
| WO | 02/098182 | A2 | 12/2002 |
| WO | 02/099780 | A2 | 12/2002 |
| WO | 03/026358 | A1 | 3/2003 |
| WO | 03/055273 | A2 | 7/2003 |
| WO | 03/067934 | A2 | 8/2003 |
| WO | 03/090890 | A1 | 11/2003 |
| WO | 03/096761 | A1 | 11/2003 |
| WO | 2004/021747 | A2 | 3/2004 |
| WO | 2004/023850 | A2 | 3/2004 |
| WO | 2004/032572 | A2 | 4/2004 |
| WO | 2004/100624 | A2 | 11/2004 |
| WO | 2005/052751 | A2 | 6/2005 |
| WO | 2005/060309 | A2 | 6/2005 |
| WO | 2005/084339 | A2 | 9/2005 |
| WO | 2005/089293 | A2 | 9/2005 |
| WO | 2005/089309 | A2 | 9/2005 |
| WO | 2006/023149 | A2 | 3/2006 |
| WO | 2006/093889 | A2 | 9/2006 |
| WO | 2006/127666 | A2 | 11/2006 |
| WO | 2006/127785 | A2 | 11/2006 |
| WO | 2006/133272 | A2 | 12/2006 |
| WO | 2007/081674 | A1 | 7/2007 |
| WO | 2007/094810 | A2 | 8/2007 |

OTHER PUBLICATIONS

International Search Report dated Jul. 17, 2009 from the corresponding International Application No. PCT/US2008/085118 filed Dec. 1, 2008.

Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.lrc.rpi.edu/programs/Futures/LF-BAS/index.asp>.

Experiment Electronic Ballast. Electronic Ballast for Fluorescent Lamps [online], Revised Fall of 2007. [Retrieved on Sep. 1, 1997]. Retrieved from Virginia Tech Web Page using Internet <URL: http://www.ece.vt.edu/ece3354/labs/ballast. pdf.>.

Truck-Lite, LEDSelect—LED, Model 35, Clearance & Marker Lighting, [online], [retrieved on Jan. 13, 2000] Retrieved from Truck-Lite Web Page using Internet <URL: http://trucklite.com/leds14.html>.

Truck-Lite, LEDSelect—LED, Super 44, Stop, Turn & Tail Lighting, [online], [retrieved on Jan. 13, 2000] Retrieved from Truck-Lite Web Page using Internet <URL: http://trucklite.com/leds2.html>.

Truck-Lite, LEDSelect—LED, Model 45, Stop, Turn & Tail Lighting [online], [retrieved on Jan. 13, 2000] Retrieved from Truck-Lite Web Page using Internet <URL: http://trucklite.com/leds4.html>.

Telecite Products & Services—Display Options, [online], [retrieved on Jan. 13, 2000] Retrieved from Telecite Web page using Internet <URL: http://www.telecite.com/en/products/options en.htm>.

Traffic Signal Products—Transportation Products Group, [online], [retrieved on Jan. 13, 2000] Retrieved from the Dialight Web Page using Internet <URL: http://www.dialight.com/trans.htm>.

LED Lights, Replacement LED lamps for any incandescent light, [online], [retrieved on Jan. 13, 2000] Retrieved from LED Lights Web Page using Internet <URL: http://www.ledlights.com/replac.htm>.

LEDTRONICS, LEDTRONICS Catalog, 1996, p. 10, LEDTRONICS, Torrance, California.

Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/p/articles/mi_qu3922/is_200005/ai_n8899499/>.

Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http://securitysolutions.com/mag/security_benefits_building_systems/>.

Phason Electronic Control Systems, Light Level Controller (LLC) case study. Nov. 30, 2004. 3 pages, Phason Inc., Winnipeg, Manitoba, Canada.

Airport International. Fly High With Intelligent Airport Building and Security Solutions [online], [retrieved on Oct. 24, 2008]. Retrieved from Airport International web page using Internet <URL: http://www.airport-int.com/categories/airport-building-and-security-solutions/fly-high-with-intelligent-airport-building-and-security-solutions.html>.

Spencer, Eugene. High Sales, Low Utilization. Green Intelligent Buildings, Feb. 1, 2007. [online]. Retrieved from Green Intelligent Buildings web page using Internet <URL: http://www.greenintelligentbuildings.com/CDA/IBT_Archive/BNP_GUID_9-5-2006_A_10000000000000056772>.

D.N.A.-111, [online], [retrieved Mar. 10, 2009] Retrieved from the PLC Lighting Web Page using Internet <URL:http://www.plclighting.com/product_info.php?cPath=1&products_id=92>.

E20116-18 Larmes Collection, [online], [retrieved on Jul. 10, 2010] Retrieved from ET2 Contemporary Lighting using Internet <URL:http://www.et2online.com/proddetail.aspx?ItemID=E20116-18>.

E20112-22 Starburst Collection, [online], [retrieved on Jul. 10, 2010] Retrieved from ET2 Contemporary Lighting using Internet <URL:http://www.et2online.com/proddetail.aspx?ItemID=E20112-22>.

E20524-10 &E20525-10 Curva Collection, [online], [retrieved on Jul. 10, 2010] Retrieved from ET2 Contemporary Lighting using Internet <URL:http://www.et2online.com/proddetail.aspx?ItemID=E20524-10&E20525-10>.

E22201-44 Esprit Collection, [online], [retrieved on Jul. 10, 2010] Retrieved from ET2 Contemporary Lighting using Internet <URL:http://www.et2online.com/proddetail.aspx?ItemID=E22201-44>.

E20743-09 Stealth Collection, [online], [retrieved on Jul. 10, 2010] Retrieved from ET2 Contemporary Lighting using Internet <URL:http://www.et2online.com/proddetail.aspx?ItemID=E20743-09>.

* cited by examiner

LED LIGHTING APPARATUS WITH SWIVEL CONNECTION

FIELD OF THE INVENTION

The present invention relates in general to light emitting diode assemblies that have a housing containing a plurality of light emitting diodes and that can be used to replace existing lamps.

BACKGROUND

Commercial lighting fixtures commonly use fluorescent lamps or incandescent lamps to give off light for illumination. These lighting fixtures have the common drawbacks of high power consumption, quick light attenuation, short service life, fragility, and the inability to be reclaimed. Light emitting diodes, hereinafter LEDs, may be used to replace fluorescent or incandescent bulbs to obtain the environmental and economic benefits of LED technology. However, LEDs are directional, and when used with existing light fixtures, they do not necessarily provide the illumination where it is needed.

Standard light tubes are mounted in a light fixture by sliding connector pins into end sockets and then turning the tube 90° so that the pins engage electrical contacts in the sockets. The lamp tube emits light omnidirectionally and its orientation in the sockets is of no consequence, making orientation of pin connectors on different models of fixtures inconsequential. However, LEDs emit light generally at a narrowly-angled conical path. An LED lighting tube retrofitted into the existing light fixture may not be oriented to emit light in the desired direction as the angular presentation of the light to the surface to be illuminated can be offset by the variation of the pin connectors.

BRIEF SUMMARY

Disclosed herein are embodiments of light emitting diode (LED) lighting apparatus with swivel connections.

One embodiment of the LED lighting apparatus disclosed herein comprises a housing with at least one end, at least one light emitting diode extending along the housing, and at least one end cap. The end cap has an opening with a sidewall to cap the end of the housing and a surface opposite the opening and spanning the sidewall. At least two pin connectors extend from the surface and are connectable to a standard light fixture. The sidewall is configured to friction fit the housing such that the housing will rotate within the end caps with application of a rotational force after connection of the pin connectors to the light fixture.

Another embodiment of the LED lighting apparatus comprises a housing with at least one end, at least one light emitting diode extending along the housing, an end cap capping the at least one end of the housing and fixed relative to the housing, and a pin pivot disk coupled to each end cap and opposite the housing. The pin pivot disk is coupled to pivot around an axis relative to the end cap. The pin pivot disk includes at least two pin connectors extending from the pin pivot disk, the pin connectors connectable to a standard light fixture.

Yet another embodiment of the LED lighting apparatus comprises a housing with at least one end, a ratchet with a gear and a pawl, at least one light emitting diode extending along the housing, at least one end cap having an opening with a sidewall to cap the end of the housing and having a surface opposite the opening and spanning the sidewall, and at least two pin connectors extending from the surface and connectable to a standard light fixture. The gear is located on one of an inner surface of the sidewall of the end cap or on the housing, and the pawl of the ratchet is located in positional agreement with the gear on the housing when the gear is located on the inner surface of the sidewall or on the inner surface of the sidewall when the gear is located on the housing.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

According to teachings herein, an LED lighting apparatus may be used to replace fluorescent or incandescent bulbs in the existing fight fixtures to obtain the environmental and economic benefits of LED technology, while providing illumination oriented to the desired surfaces or areas.

Embodiments of the LED lighting apparatus with swivel connectors are taught herein with reference to the accompanying drawings.

Figure 1:
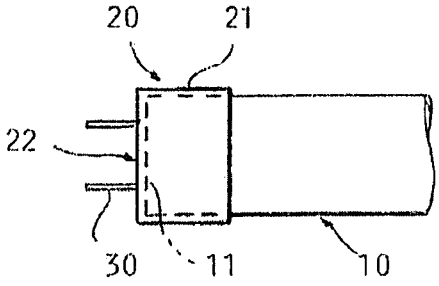
FIG. 1 illustrates a first embodiment of the LED lighting apparatus.

A first embodiment of the LED lighting apparatus with swivel connectors is illustrated in FIG. 1. The housing 10 for at least one LED (not shown) is depicted by broken lines. The end 11 of the housing 10 is capped with an end cap 20. The end cap 20 is friction-fitted onto the end of the housing. The end cap 20 has a sidewall 21 that surrounds the end 11 of the housing 10 and a surface 22 that spans the sidewall 21. From the surface 22 extend at least two pin connectors 30 that connect the housing to a standard fluorescent or incandescent light fixture (not shown). The pin connectors 30 are inserted into the socket or sockets of the lighting fixture. Once the pin connectors 30 are secure in the sockets of the light fixture, the housing 10 can be rotated relative to the end caps 20 with the application of rotational force on the housing. This rotational force can direct the light from the LEDs to illuminate the desired surface or area. The friction fit of the end cap 20 on the housing end 11 allows for rotation during application of force, with the housing maintaining the final position after rotational force is lifted.

As depicted, the housing is tubular with at least one end. The embodiments disclosed herein are not limited to such a housing. It is contemplated that the housing may be of any suitable shape that can be used with fluorescent or incandescent light fixtures. As a non-limiting example, the housing may be a shroud open along its length. The housing may have as many ends as necessary for a secure fit and the proper electrical connection. The housing may be made of any material known in the art to be used in the lighting industry, including but not limited to UV resistant plastic or glass.

Figure 8:
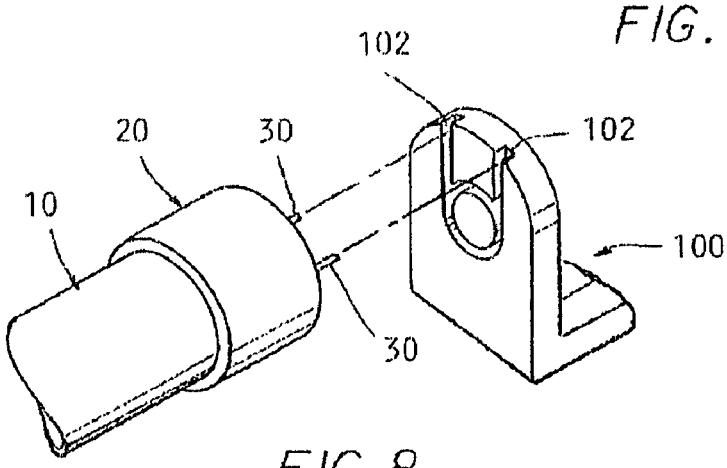
FIG. 8 is a fragmentary, perspective view of one embodiment showing one end of the housing with an end cap disconnected from a light tube socket of a lighting fixture.

FIG. 8 is a fragmentary, perspective view, of the housing 10 with an end cap 20 disconnected from one end of a light tube socket 100 of a light fixture. As with conventional lighting systems, the light tube socket 100 includes a pair of electrical female connectors 102 for receiving the pin connectors 30 extending from the end cap 20.

The LEDs utilized in the lighting apparatus are those known in the art. More than one LED is commonly referred to as a bank or array of LEDs. Within the scope of these embodiments, the housing 10 may include one or more banks or arrays of LEDs mounted on one or more circuit boards. The LEDs can emit white light and, thus, are commonly referred to in the art as white LEDs. The LEDs can be mounted, for example, to one surface of the circuit board. The LEDs can be arranged on the circuit board or another surface to emit or shine white light through only one side of housing, thus directing the white light to a predetermined point of use, or arranged to emit fight through more than one side of the housing. These examples are non-limiting and provided to further illustrate the housing with which the end caps are used.

Figure 2:
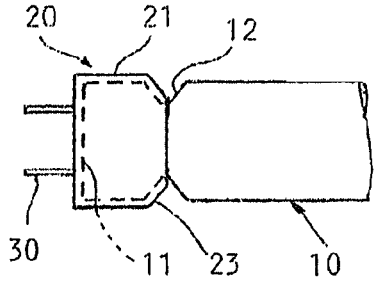
FIG. 2 illustrates a variation of the first embodiment of the LED lighting apparatus.

FIG. 2 illustrates a variation of the first embodiment of the LED lighting apparatus. In FIG. 2 the housing 10 has a crimp 12 along the circumference of the housing a distance in from the end 11 of the housing 10. The sidewall 21 of the end cap 20 has an inward angled edge 23 that is positioned to friction contact the housing 10 at the crimp 12. The end cap 20 and housing 10 are friction fit such that the rotational force that must be applied to align the LED light is greater than that force required to insert the housing 10 with end caps into the sockets of the lighting fixture (not shown). Thus, a force is required to insert the housing 10 into the fixture, and a greater force is required to adjust the housing 10 so that the desired surface or area is illuminated. Once adjustment is complete and the force is lifted, the housing 10 maintains its position due to the friction fit with the end cap 20.

Figure 3:
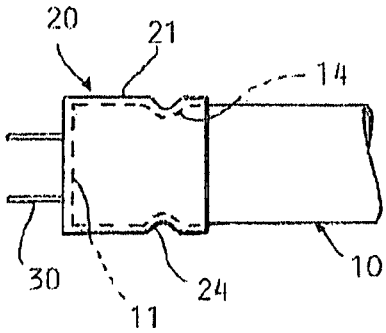
FIG. 3 illustrates another variation of the first embodiment of the LED lighting apparatus.

FIG. 3 is yet another variation of the first embodiment of the LED lighting apparatus. In FIG. 3, the housing 10 has a crimp 14 along the circumference of the housing a distance in from the end 11 of the housing 10. The sidewall 21 of the end cap 20 has a friction contact portion 24 located on the sidewall and running the circumference of the sidewall. The friction contact portion 24 is positioned to marry the crimp 14 of the housing 10 when the end cap 20 is capping die end 11 of the housing 10. The friction fit between the end cap 20 and the housing 10 is such that the rotational force that must be applied to align the LED light is greater than that force required to insert the housing end cap(s) into the sockets of the lighting fixture. Thus, a force is required to insert the housing 10 into the fixture, and a greater force is required to adjust the housing 10 so that the desired surface or area is illuminated. Once adjustment is complete and the force is lifted, the housing 10 maintains its position due to the friction fit.

The friction fit may be obtained by crimping or other means such as press-fitting. These are non-limiting examples and other means are contemplated.

Figure 4:
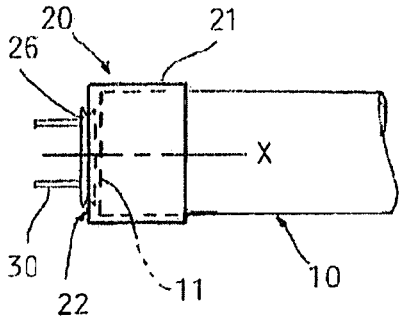
FIG. 4 illustrates a second embodiment of the LED lighting apparatus.

A second embodiment of the LED lighting apparatus is illustrated in FIG. 4. Elements of the second embodiment having the same function as in the first embodiment are denoted by the same reference numerals and duplicate explanations thereof are omitted herein.

In FIG. 4, the housing 10 for at least one LED (not shown) is again depicted by broken lines. The end 11 of the housing 10 is capped with an end cap 20. The end cap 20 has a sidewall 21 that surrounds the end 11 of the housing 10 and a surface 22 that spans the sidewall 21. Located within the surface 22 is a pin pivot disk 26 coupled to the surface 22. The pin pivot disk 26 is coupled so that it can pivot around an axis X relative the end cap 20. From the pin pivot disk 26 extend at least two pin connectors 30 that connect the housing to a standard fluorescent or incandescent light fixture. The pin connectors 30 are inserted into the socket or sockets of the lighting fixture and are locked into place.

In this embodiment, the end cap 20 and housing 10 do not move relative to each other. Once the pin connectors 30 are inserted into the socket of the fixture (not shown), the housing 10 and end cap 20 can be aligned relative to the pin pivot disk 26 and fixture by the application of a rotational force on the housing 10 or end cap(s) 20. The housing 10 and end cap(s) 20 remain in the desired alignment when the force is lifted.

Figure 5:
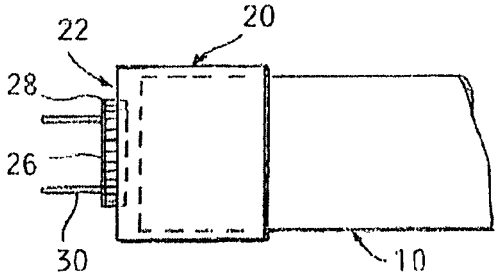
FIG. 5 illustrates a variation of the second embodiment of the LED lighting apparatus.
Figure 5A:
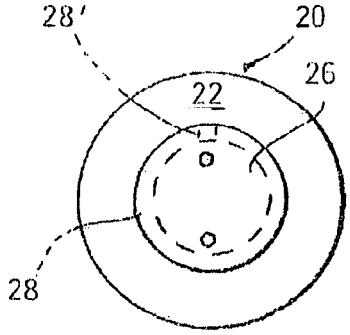
FIG. 5A is a view of the face of an end cap alternative for the second embodiment of the LED lighting apparatus.

FIG. 5 depicts a variation of the second embodiment of the LED lighting apparatus disclosed herein. In this variation of the second embodiment, the pin pivot disk 26 is a ratchet gear. The edge 28 of the surface 22 into which the ratcheted pin pivot disk 26 is coupled acts as the pawl of the ratchet. The edge 28 may have a different configuration from that shown in FIG. 5. For example, it may be thicker than the typical edge of the surface 22, or it may be of a different material. FIG. 5A illustrates the surface 22 of the end cap 20 shown without the pivot disk 26, the edge 28 having a pawl 28' extending from it, rather than the edge 28 itself being configured as a pawl.

Again in this variation the end cap 20 and housing 10 do not move relative to each other. Once the pin connectors 30 are inserted into the socket of the fixture (not shown), the housing 10 and end cap 20 can be aligned relative to the ratcheted pin pivot disk 26 and fixture by the application of a rotational force on the housing 10 or end cap(s) 20 that moves the ratchet gear (pin pivot disk 26) relative to the pawl 28' (or edge 28 of the surface 22). The housing 10 and end cap(s) 20 remain in the desired alignment when the force is lifted. To achieve this, either the pawl 28' or the teeth of the ratchet gear (pin pivot disk 26) is flexible such that the rotation of the housing 10 and end cap(s) 20 is allowed while maintaining the pin connectors 30 in the socket.

Figure 6:
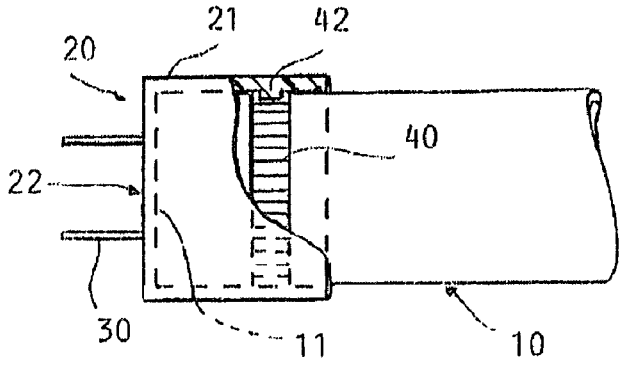
FIG. 6 illustrates a third embodiment of the LED lighting apparatus.

A third embodiment of the LED lighting apparatus with swivel connections is illustrated in FIG. 6. In FIG. 6, the housing 10 for at least one LED (not shown) is again depicted by broken lines. The end 11 of the housing 10 is capped with an end cap 20. The end cap 20 has a sidewall 21 that surrounds the end 11 of the housing 10 and a surface 22 that spans the sidewall 21. Extending from the surface 22 are at least two pin connectors 30 that connect the housing to a standard fluorescent or incandescent light fixture (not shown). The pin connectors 30 are inserted into the socket or sockets of the lighting fixture.

In FIG. 6 the housing 10 has a ratchet gear 40 positioned a distance in from the end 11 of the housing 10. The ratchet gear 40 is positioned so that the teeth of the gear are flush with the housing 10. The sidewall 21 of the end cap 20 has a pawl 42 that is positioned to correspond to the ratchet gear 40 when the end cap 20 is positioned on the end 11 of the housing 10. The end cap 20, after the pin connectors 30 are inserted into the socket, does not move relative to the lighting fixture. During insertion of the pin connectors with rotational movement, the pawl 42 is positioned to rotate against the teeth of the ratchet gear 40. Thus resistance against the teeth is high. Once the pin connectors 30 are inserted, the housing 10 can be aligned relative to the end cap 20 and fixture by the application of a rotational force on the housing 10 that moves the ratchet gear relative to the pawl 42, with the pawl 42 moving with the teeth of the ratchet gear 40. The housing 10 and end cap(s) 20 remain in the desired alignment when the force is lifted. To achieve this, either the pawl 42 or the teeth of the ratchet gear 40 is flexible such that the rotation of the housing 10 is allowed after the pin connectors 30 are inserted.

Figure 7:
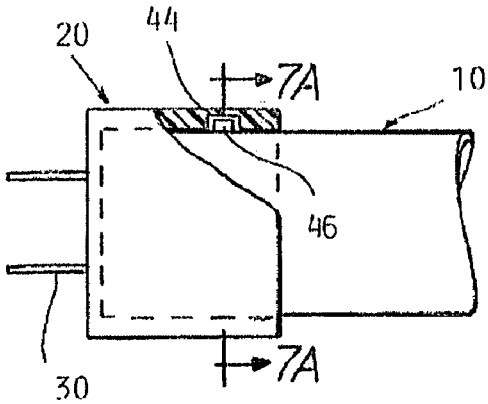
FIG. 7 illustrates a variation of the third embodiment of the LED lighting apparatus.
Figure 7A:
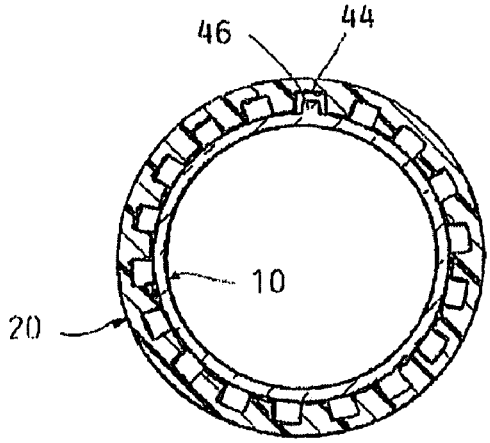
FIG. 7A illustrates the cross, sectional view of the end cap across lines A-A' shown in FIG. 7.

FIG. 7 illustrates a variation of the third embodiment of the LED lighting apparatus. In this variation, the pawl 46 is positioned on the exterior of the housing 10 a distance from the end 11. The ratchet gear, shown in FIG. 7A, is integral to the end cap 20 and positioned so that when the end cap 20 is capping the end 11 of the housing 10, the pawl 46 and the ratchet gear are in alignment. FIG. 7A is a cross sectional view of the end cap 20 along line A-A' of FIG. 7 illustrating the position of the ratchet gear 44. The end cap 20, after the pin connectors 30 are inserted into the socket, does not move relative to the lighting fixture. During insertion of the pin connectors with rotational movement, the pawl 46 is positioned to rotate against the teeth of the ratchet gear 44. Thus resistance against the teeth is high. Once the pin connectors 30 are inserted, the housing 10 can be aligned relative to the end cap 20 and fixture by the application of a rotational force on the housing 10 that moves the ratchet gear relative to the pawl 46, with the pawl 46 moving with the teeth of the ratchet gear 44. The housing 10 and end cap(s) 20 remain in the desired alignment when the force is lifted. Again, either the pawl 46 or the teeth of the ratchet gear 44 is flexible such that the rotation of the housing 10 is allowed after the pin connectors 30 are inserted.

With any of the embodiments of the LED lighting apparatus disclosed herein, it is contemplated that means to limit the available rotation of the LED housing or housing and end cap may be incorporated. By limiting the available rotation of the housing and/or the end cap, the wires connected from the pins to the LED array are not twisted and strained. This, in turn, should decrease wear and lengthen the life of the electrical connection so that the advantage of extended life of the LEDs can be further realized.

Figure 9:
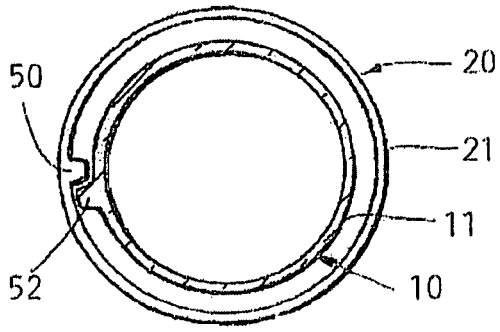
FIG. 9 illustrates an embodiment of an over-rotation prevention device.

One way in which to avoid over-rotation of the housing 10 for the first and third embodiments, and over-rotation of both the housing 10 and end caps 20 of the second embodiment, is to provide a stop in the end cap 20 and a corresponding stop in the housing. As illustrated in FIG. 9, a stop 50 extends from the inside of the sidewall 21 of the end cap 20. A corresponding stop 52 extends from the housing 10 at a position on the end 11 such that the stops 50, 52 will engage one another at one point during rotation. The stops 50, 52 can be made from any material that is strong enough to withstand the rotational force applied by a user of the lighting apparatus.

Alternative configurations of the stop are contemplated. One such example involving the ratchet of the second embodiment incorporates locating teeth in only a portion of the ratchet gear 40, 44 so that the pawl is prevented from further rotation along the ratchet gear 40, 44. Based on the teachings herein, it should be recognized by those skilled in the art that these stop configurations are provided by way of example and not limitation, and that other suitable stop configurations may be used.

Figure 10:
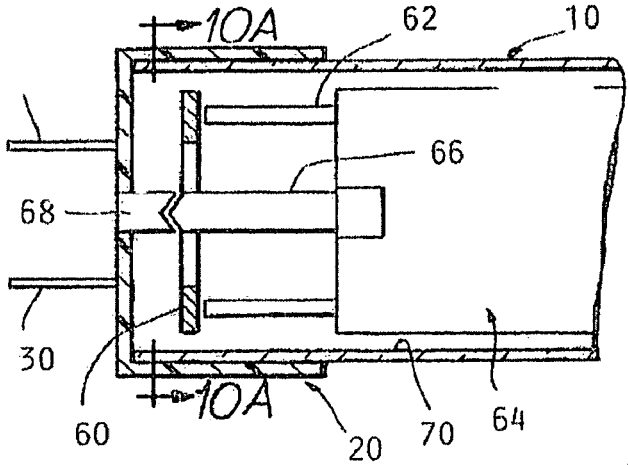
FIG. 10 illustrates another embodiment of an over-rotation prevention device.
Figure 10A:
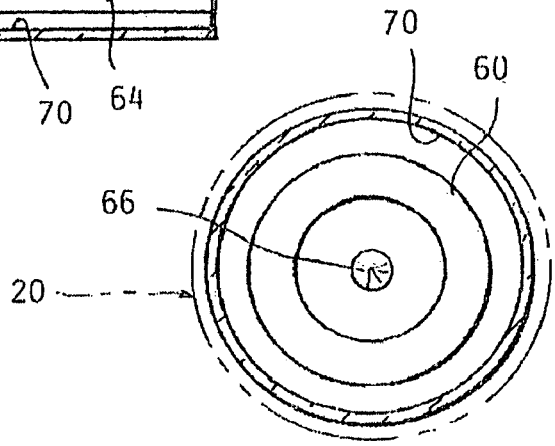
FIG. 10A is a cross-sectional view of the device of FIG. 10.

Other ways to prevent twisting of the electrical connections due to rotation of the housing 10 or housing 10 and end cap 20 may be used. One such embodiment incorporates the use of slip rings as illustrated in FIG. 10. The slip ring 60 comprises a conductive circle or band mounted within the housing 10. Electrical connections 62 from the LED array or LED circuit board 64 are made to the slip ring 60 and are omitted here for clarity. A spring loaded center contact 66, located along the center axis of the housing 10, transfers the electrical power from a socket 68 configured in the end cap 20, which in turn transfers the electrical power torn the pins 30 that are inserted into the socket of the fixture (not shown in FIG. 10). The electrical connections 62 may also be spring loaded. As used herein, a slip ring is an electrical connection through a rotating assembly. Accordingly, alternative constructions of such a slip ring are possible and can include, for example, rotary electrical interfaces, rotating electrical connectors, collectors, swivels, electrical rotary joints, etc. FIG. 10A is a cross-sectional view of the housing 10 along dotted line 10A, showing the slip ring 60 positioned within the housing wall 70, with the spring loaded center contact 66 at the center. The end cap is omitted from FIG. 10A.

Figure 11:
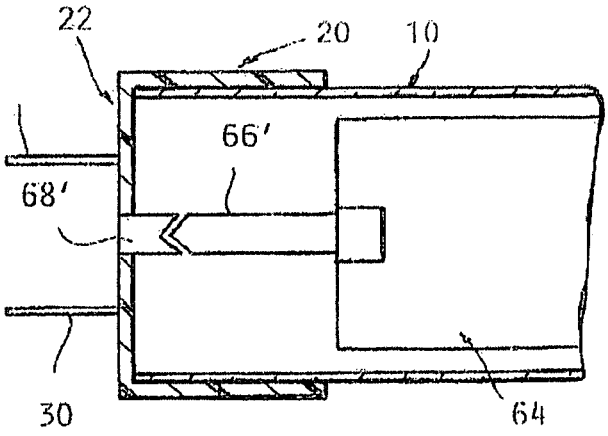
FIG. 11 is an illustration of an over-rotation device for a single socket fixture.

FIG. 11 is an alternative embodiment of the electrical connection over-rotation prevention for housings with only one electrical connection, rather than the two connections used with a traditional fluorescent fixture. In FIG. 11, the electrical connections (not shown) from the LED array or circuit board 64 are connected, to a spring loaded contact pin 66' located along the center axis of the housing 10. A socket 68' in the center of the end cap 20 surface 22, which draws electrical power through the pins 30 of the end cap 22, is in contact with the spring loaded contact pin 66'. Since the electrical connections to both the socket 68' and the spring loaded contact pin 66' do not rotate relative to the connection points, strain and stress on the connections are reduced.

White the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A LED lighting apparatus for use in a standard light fixture, the apparatus comprising:

a housing with at least one end;

at least one light emitting diode extending along the housing; and at least one end cap, wherein the end cap has an opening with a sidewall to cap the end of the housing; wherein the sidewall has a protrusion extending inward and the housing further comprises a corresponding recess in the housing and spaced between the end and a longitudinal center of the housing, the protrusion aligning within the recess when the end cap caps the end of the housing to friction fit the housing such that the housing will rotate to a plurality of illuminating positions within the end caps with application of a rotational force after insertion of the housing in the light fixture, the friction fit maintaining the housing in one of the plurality of illuminating positions to which the housing was rotated.

2. The apparatus of claim 1, along the circumference of the housing wherein the rotational force required for alignment with any one of the plurality of illuminating positions is greater than a force required for insertion into the light fixture.

3. The apparatus of claim 1, wherein the friction fit is obtained by crimping or press-fitting.

4. The apparatus of claim 1, wherein the end cap has a first stop extending from the sidewall into the opening and the at least one end of the housing has a second stop positioned for engagement with the first stop to limit a rotational range of the housing.

5. The apparatus of claim 1, further comprising:

a slip ring and a spring loaded contact located within the at least one end of the housing, wherein an electrical connection from the at least one light emitting diode contacts the slip ring and the spring loaded contact transfers electrical power from the electrical connection to pin connectors extending from the end cap via a socket on the end cap.

6. The apparatus of claim 1, wherein the housing has one end, the apparatus further comprising:

a socket located on the end cap and configured to transfer electrical power from pin connectors extending from the end cap to the at least one light emitting diode via a spring loaded contact pin.

* * * * *